US008577687B2

(12) United States Patent
Kovesi et al.

(10) Patent No.: US 8,577,687 B2
(45) Date of Patent: Nov. 5, 2013

(54) HIERARCHICAL CODING OF DIGITAL AUDIO SIGNALS

(75) Inventors: Balazs Kovesi, Lannion (FR); Stéphane Ragot, Lannion (FR)

(73) Assignee: France Telecom, Paris (FR)

( * ) Notice: Subject to any disclaimer, the term of this patent is extended or adjusted under 35 U.S.C. 154(b) by 925 days.

(21) Appl. No.: 12/667,724

(22) PCT Filed: Jul. 4, 2008

(86) PCT No.: PCT/FR2008/051248
§ 371 (c)(1),
(2), (4) Date: Feb. 25, 2010

(87) PCT Pub. No.: WO2009/010674
PCT Pub. Date: Jan. 22, 2009

(65) Prior Publication Data

US 2010/0191538 A1 Jul. 29, 2010

(30) Foreign Application Priority Data

Jul. 6, 2007 (FR) ..... 07 56326

(51) Int. Cl.
*G10L 19/00* (2013.01)

(52) U.S. Cl.
USPC ..... 704/500

(58) Field of Classification Search
None
See application file for complete search history.

(56) References Cited

U.S. PATENT DOCUMENTS 3,688,097 A * 8/1972 Montgomery ..... 708/208
4,386,237 A * 5/1983 Virupaksha et al. ..... 704/224
4,633,483 A * 12/1986 Takahashi et al. ..... 375/244
5,068,899 A * 11/1991 Ellis et al. ..... 704/212
6,349,284 B1 * 2/2002 Park et al. ..... 704/500
7,009,935 B2 * 3/2006 Abrahamsson et al. ..... 370/228
7,142,604 B2 * 11/2006 De Lameillieure ..... 375/240.26
7,272,567 B2 * 9/2007 Fejzo ..... 704/500

(Continued)

OTHER PUBLICATIONS

Kovesi, B.; Ragot, S.; Le Guyader, A., "An 64-80-96 kbit/s scalable wideband speech coding candidate for ITU-T G.711-WB standardization," Acoustics, Speech and Signal Processing, 2008. ICASSP 2008. IEEE International Conference on , vol., no., pp. 4801,4804, Mar. 31, 2008-Apr. 4, 2008.*

(Continued)

*Primary Examiner* — Brian Albertalli
(74) *Attorney, Agent, or Firm* — Drinker Biddle & Reath LLP

(57) ABSTRACT

The invention relates to a method for scalar quantization-based coding of the samples of a digital audio signal (S), the samples being coded over a pre-determined number of bits in order to obtain a binary frame of quantization indices ($I_{PCM}$), the coding being carried out according to an amplitude compression law, where a pre-determined number of least significant bits are not taken into account in the binary frame of quantization indices. The coding method comprises the steps for storing (27) at least a part of the least significant bits that are not taken into account in the quantization index binary frame and for determination (28) of an enhancement bit stream ($I_{EXT}$) comprising at least one bit thus stored.
The invention also relates to an associated decoding method which comprises the steps for receiving (29) an enhancement bit stream ($I'_{EXT}$) comprising one or more extension bits and for concatenation (30) of the extension bits behind the bits coming from the binary frame in order to obtain a decoded audio signal.
The invention also relates to the coder and decoder implementing these methods.

10 Claims, 5 Drawing Sheets

(56) References Cited

U.S. PATENT DOCUMENTS

| | | | | |
|---|---|---|---|---|
| 7,330,812 | B2 * | 2/2008 | Ding | 704/200.1 |
| 7,362,811 | B2 * | 4/2008 | Dunne et al. | 375/241 |
| 7,408,918 | B1 * | 8/2008 | Ramalho | 370/351 |
| 2004/0208169 | A1 * | 10/2004 | Reznik | 370/352 |

OTHER PUBLICATIONS

Hiwasaki et al., "G.711.1: A Wideband Extension to ITU-T G.711", 16th European Signal Processing Conference (EUSIPCO 2008), Lausanne, Switzerland, Aug. 25-29, 2008.*

Davis et al., "A Scaleable Audio Codec," External Research Web Site of British Telecom, pp. 1-7 (1998).

Davis et al., "A Scaleable Audio Codec," pp. 1-13, retrieved from internet website: http://66.102.1.104/scholar?hl=fr&lr=&q=cache:LDulMfOP__AcJ:research.btexact.com/edge/papers/focuspapers/QoSForRealTimeA... (retrieved Mar. 7, 2008).

Google Scholar Search Results for "A Scaleable audio codec," pp. 1-2, retrieved from internet website: http://scholar.google.com/scholar?q=%22+a+scaleable+audio+codec%22&hl=fr&lr=&lr= (retrieved Mar. 7, 2008).

Internet Archive Wayback Machine Search Results for "http:///research.btexact.com/edge/papers/index.htm," p. 1, retrieved from internet website: http://web.archive.org/web/*/http://research.btexact.com/edge/papers/index.htm (retrieved Mar. 7, 2008).

Internet Archive Wayback Machine Search Results for "http://research.btexact.com/edge/papers/index.htm—Version du Oct. 30, 2004," pp. 1-25, retrieved from internet website: http://web.archive.org/web/20041030234723/http://research.btexact.com/edge/papers/index.htm (retrieved Mar. 7, 2008).

Internet Archive Wayback Machine Search Results for "http://research.btexact.com/edge/papers/focuspapers/QoSForRealTimeApp/ScalableMpeg_vOb.pdf—Version due Oct. 30, 2004," p. 1, retrieved from Internet website: http://web.archive.org/web/20041030234723/http://research.btexact.com/edge/papers/focuspapers/QoSForRealTimeApp/ScalableMpeg_v0b.pdf (retrieved Mar. 7, 2008).

Marks, "Joint Source/Channel Coding for Mobile Audio Streaming," retrieved from internet website: http://www4.gu.edu.au:8080/adt-root/uploads/approved/adt-QGU20070228.161413/public/02Whole.pdf pp. 1-339 (2000).

* cited by examiner

HIERARCHICAL CODING OF DIGITAL AUDIO SIGNALS

CROSS-REFERENCE TO RELATED APPLICATIONS

This application is the U.S. national phase of the International Patent Application No. PCT/FR2008/051248 filed Jul. 4, 2008, which claims the benefit of French Application No. 07 56326 filed Jul. 6, 2007, the entire content of which is incorporated herein by reference.

FIELD OF THE INVENTION

The present invention relates to a method for hierarchical coding of audio data, more particularly for scalar quantization-based coding.

BACKGROUND OF THE INVENTION

This coding is notably designed for the transmission and/or for the storage of digital signals such as audio frequency signals (speech, music or others).

The present invention relates more particularly to the coding of waveforms such as PCM (for "Pulse Code Modulation") coding where each input sample is coded individually, without prediction.

The general principal of PCM coding/decoding specified by the recommendation UIT-T G.711 is such as described with reference to FIG. 1. The input signal is assumed to be defined with a minimum bandwidth of [300-3400 Hz] and sampled at 8 kHz, with a resolution of 16 bits per sample (in a format known as "linear PCM").

The PCM coder 13 comprises a quantization module $Q_{PCM}$ 10 which receives the input signal S at its input. The quantization index $I_{PCM}$ at the output of the quantization module 10 is transmitted via the transmission channel 11 to the decoder 14.

The decoder PCM 14 receives at its input the indices $I_{PCM}$ coming from the transmission channel, a version which could be affected by binary errors of $I_{PCM}$, and carries out an inverse quantization by the inverse quantization module $Q^{-1}_{PCM}$ 12 in order to obtain the coded signal $S'_{Mic}$.

The normalized UIT-T G.711 PCM coding (hereinafter referred to as G.711) carries out a compression of the amplitude of the signals with a logarithmic curve prior to uniform scalar quantization, which allows an approximately constant signal-to-noise ratio to be obtained for a wide dynamic range of signals. The quantization step in the frequency range of the original signal is therefore proportional to the amplitude of the signals.

The successive samples of the compressed signal are quantized over 8 bits, or 256 levels. In the Public Switched Telephone Network (PSTN), these 8 bits are transmitted at a frequency of 8 kHz giving a bit rate of 64 kbits/s.

A quantized signal frame according to the G.711 standard is composed of quantization indices coded over 8 bits. Thus, if the inverse quantization is applied by table, it simply consists of the index pointing to one of the 256 possible decoded values.

For reasons of complexity of implementation, the PCM compression has been approximated by a segmented linear curve.

Two coding laws are defined in the G.711 standard: law A, mainly used in Europe, and mu (μ) law used in North America and in Japan.

These coding laws allow an amplitude compression (or "companding") to be applied to the signal. The amplitude of the signal is thus "compressed" with a non-linear function in the coder, sent over a transmission channel and "decompressed" with the inverse function in the decoder. The advantage of amplitude compression is that it allows the probability distribution of the amplitude of the input audio signal to be transformed into a quasi-uniform probability law, on which a uniform scalar quantization can be applied.

The laws of amplitude compression are generally laws of the logarithmic type which therefore allow a signal sampled with a resolution of 16 bits (in "linear PCM" format) to be coded over 8 bits (in "PCM" format of the law A or mu type).

The 8 bits per sample in G.711 are allocated in the following manner such as is shown at reference 15 in FIG. 1:

1 sign bit S (0 for a negative value, otherwise 1), assigned the reference sgn in FIG. 1, 3 bits to indicate the segment (reference ID-SEG in FIG. 1), the end of each segment being given by 256*2n for the A law and 256*2n−132 for the mu law where n=0, 1, . . . , 7. The quantization step is therefore multiplied by 2 when going to the higher segment (starting from the $2^{nd}$ segment for the A law).

4 bits for indicating the location on the segment, assigned the reference ID-POS in FIG. 1.

The last 7 bits therefore constitute the coded absolute value. In the following we will firstly study the case of law A, then the results are generalized for the mu law. According to the A law G.711 standard, the final index is obtained by inverting each second bit starting from the Least Significant Bit or LSB. This coding law allows a scalar quantization precision of 12 bits (hence a quantization step of 16) on the first two segments, then the precision decreases by 1 bit when the segment number increases by 1.

It can be noted that it is possible to perform the G.711 PCM quantization starting from a digital signal represented over 16 bits by carrying out simple comparisons between the amplitude of the sample to be coded and the decision thresholds of the quantifier. The use of a dichotomy significantly accelerates these comparisons. This solution requires a table with 256 entries to be stored; table 1 hereinbelow presents an extract from such a table for the G.711 law A.

TABLE 1

Thresholds for searching by dichotomy

| N° of the interval | Lower threshold | Upper threshold | Sign | Coded absolute value | Final index | Quantized value |
|---|---|---|---|---|---|---|
| 0 | −32768 | −31745 | 0 | 127 | 0x2a | −32256 |
| 1 | −31744 | −30721 | 0 | 126 | 0x2b | −31232 |
| . . . | . . . | | | . . . | . . . | . . . |
| 122 | −96 | −81 | 0 | 5 | 0x50 | −88 |
| 123 | −80 | −65 | 0 | 4 | 0x51 | −72 |
| 124 | −64 | −49 | 0 | 3 | 0x56 | −56 |
| 125 | −48 | −33 | 0 | 2 | 0x57 | −40 |
| 126 | −32 | −17 | 0 | 1 | 0x54 | −24 |
| 127 | −16 | −1 | 0 | 0 | 0x55 | −8 |
| 128 | 0 | 15 | 1 | 0 | 0xd5 | 8 |
| 129 | 16 | 31 | 1 | 1 | 0xd4 | 24 |
| 130 | 32 | 47 | 1 | 2 | 0xd7 | 40 |
| 131 | 48 | 63 | 1 | 3 | 0xd6 | 56 |
| 132 | 64 | 79 | 1 | 4 | 0xd1 | 72 |
| 133 | 80 | 95 | 1 | 5 | 0xd0 | 88 |
| . . . | . . . | . . . | | | . . . | . . . |
| 254 | 30720 | 31743 | 1 | 126 | 0xab | 31232 |
| 255 | 31744 | 32767 | 1 | 127 | 0xaa | 32256 |

For example, an original sample of the signal S to be coded has an amplitude equal to −75. Consequently, this amplitude is included in the interval [−80, −65] of the line 123 (or "level" 123) of the table. The coding of this information consists in delivering a coded final index, referenced $I'_{Mic}$ in FIG. 1 and in table 1, which is equal to 0x51. At the decoding, the inverse quantization operation therefore consists in recovering the index $I'_{Mic}$=0x51 and in making a quantized value VQ, such as VQ=−72, correspond to it. Consequently, the decoding assigns this value −72 to the amplitude of the corresponding sample of the decoded signal $S'_{Mic}$. It will be mentioned that this same value VQ=−72 would be assigned to all the samples to be decoded and whose initial amplitude had a value in the interval [−80, −65], being 16 possible values in all within the interval, which corresponds to the quantization step here of 16. On the other hand, it will be noted that the same value VQ=32256 would be assigned to all the samples whose initial amplitude was in the interval [31744, 32767], being 1024 possible values in all, which corresponds to a quantization step of 1024.

The signal-to-noise ratio (SNR) obtained by the PCM coding is more or less constant (~38 dB) for a wide dynamic range of signals. The quantization step in the frequency range of the original signal is proportional to the amplitude of the signals. This signal-to-noise ratio is not sufficient to make the quantization noise inaudible over the whole band of frequencies 0-4000 Hz. Moreover, for low-level signals (which are coded with the first segment) the SNR is very poor.

The G.711 standard is generally considered as being of good quality for narrow-band telephony applications with terminals limiting the band to [300-3400 Hz]. However, the quality is not high enough when G.711 is used for other applications such as, for example, for high-fidelity terminals in the band [50, 4000 Hz] or for the wideband hierarchical extension of the G.711 coding.

For this reason, there do exist methods of hierarchical coding consisting in generating an enhancement layer determined from the coding noise of the G.711 coder. This coding noise is then coded by a technique different from G.711, which forms the layer known as 'base layer' (or 'core layer'). Such a method of hierarchical coding is for example described in the document: Y. Hiwasaki, H. Ohmuro, T. Mori, S. Kurihara and A Kataoka. "A G.711 embedded wideband speech coding for VoIP conferences", IEICE Trans. Inf. & Syst, Vol. E89-D, no 9, September 2006. This type of method has the drawback of very significantly increasing the complexity of the coder, whereas coding of the PCM type is reputed to be of low complexity. Moreover, since the PCM coding noise is a white noise, hence uncorrelated, the coding of this type of noise is difficult to implement because compression techniques are essentially based on extraction properties from the correlation of the signal to be coded.

SUMMARY OF THE INVENTION

The present invention offers a solution that improves the situation.

For this purpose, the invention provides a method for scalar quantization-based coding of the samples of a digital audio signal, the samples being coded over a pre-determined number of bits in order to obtain a binary frame of quantization indices, the coding being carried out according to an amplitude compression law, where a pre-determined number of least significant bits are not taken into account in the binary frame of quantization indices. The method is such that it comprises the following steps:

- storage of at least a part of the least significant bits that are not taken into account in the quantization index binary frame;
- determination of an enhancement bit stream comprising at least one bit thus stored.

Thus, an enhancement bit stream is transmitted at the same time as the binary frame of quantization indices.

This extension bit stream is determined by taking advantage of the least significant bits that are not used during the coding. This method therefore has the advantage of not adding complexity to the coder and of providing the desired improvement in quality by providing the decoder with the possibility of obtaining a better decoding precision.

In one embodiment, the stored bits are the most significant bits amongst the bits that are not taken into account in the binary frame of quantization indices.

All the bits put aside during the application of the logarithmic coding law are not necessarily included in the extension bit stream. It is thus possible to determine an extension bit stream according to the requirements in quality and availability in terms of bit rate.

In one variant embodiment, the number of bits taken into account for determining the enhancement bit stream is a function of the bit rate available during a transmission to a decoder.

Thus, the extension bit stream may be modulated in the course of the transmission depending on the available bit rate.

The invention is particularly well suited to the case where the scalar quantization step is a quantization of the PCM type according to a logarithmic amplitude compression coding law of the A type or of the mu type in accordance with the ITU-T G.711 standard.

The invention is also applicable to a method for decoding a binary frame of quantization indices comprising a pre-determined number of bits by an inverse quantization step and according to an amplitude compression law. The method is such that it comprises the following steps:

- reception of an enhancement bit stream comprising one or more extension bits;
- concatenation of the extension bits behind the bits coming from the binary frame in order to obtain a decoded audio signal.

The decoder that receives extension bits thus improves the precision of its expansion or "decompression" by concatenating the extension bits received to those present in the quantization index frame received from the basic bit stream.

In one preferred embodiment, the method also comprises a step for adapting a rounding value according to the number of extension bits received in order to obtain the decoded audio signal.

The detection of the coded audio signal is thus adapted according to the number of bits in the extension bit stream.

The invention also relates to an audio coder comprising a module for scalar quantization of the samples of a digital audio signal, the samples being coded over a pre-determined number of bits in order to obtain a binary frame of quantization indices, the coding being applied according to an amplitude compression law, a pre-determined number of least significant bits not being taken into account in the binary frame of quantization indices. The coder according to the invention comprises:

- a memory space capable of storing at least a part of the least significant bits that are not taken into account in the quantization index binary frame;
- means for determining an enhancement bit stream comprising at least one bit thus stored.

The invention relates to an audio decoder capable of decoding a binary frame of quantization indices comprising a predetermined number of bits by an inverse quantization module and according to an amplitude compression law. The decoder according to the invention comprises:

means for receiving an enhancement bit stream comprising one or more extension bits;

means for concatenation of the extension bits behind the bits coming from the binary frame in order to obtain a decoded audio signal.

Lastly, the invention is aimed at a computer program designed to be stored in a memory of a coder and/or a storage medium capable of cooperating with a drive of the coder, comprising code instructions for the implementation of the steps of the coding method according to the invention when it is executed by a processor of the coder.

Similarly, the invention is aimed at a computer program designed to be stored in a memory of a decoder and/or a storage medium capable of cooperating with a drive of the decoder, comprising code instructions for the implementation of the steps of the coding method according to the invention when it is executed by a processor of the decoder.

BRIEF DESCRIPTION OF THE DRAWINGS

Other features and advantages of the invention will become more clearly apparent upon reading the following description, presented by way of non-limiting example and with reference to the appended drawings, in which.

DETAILED DESCRIPTION

Figure 2:
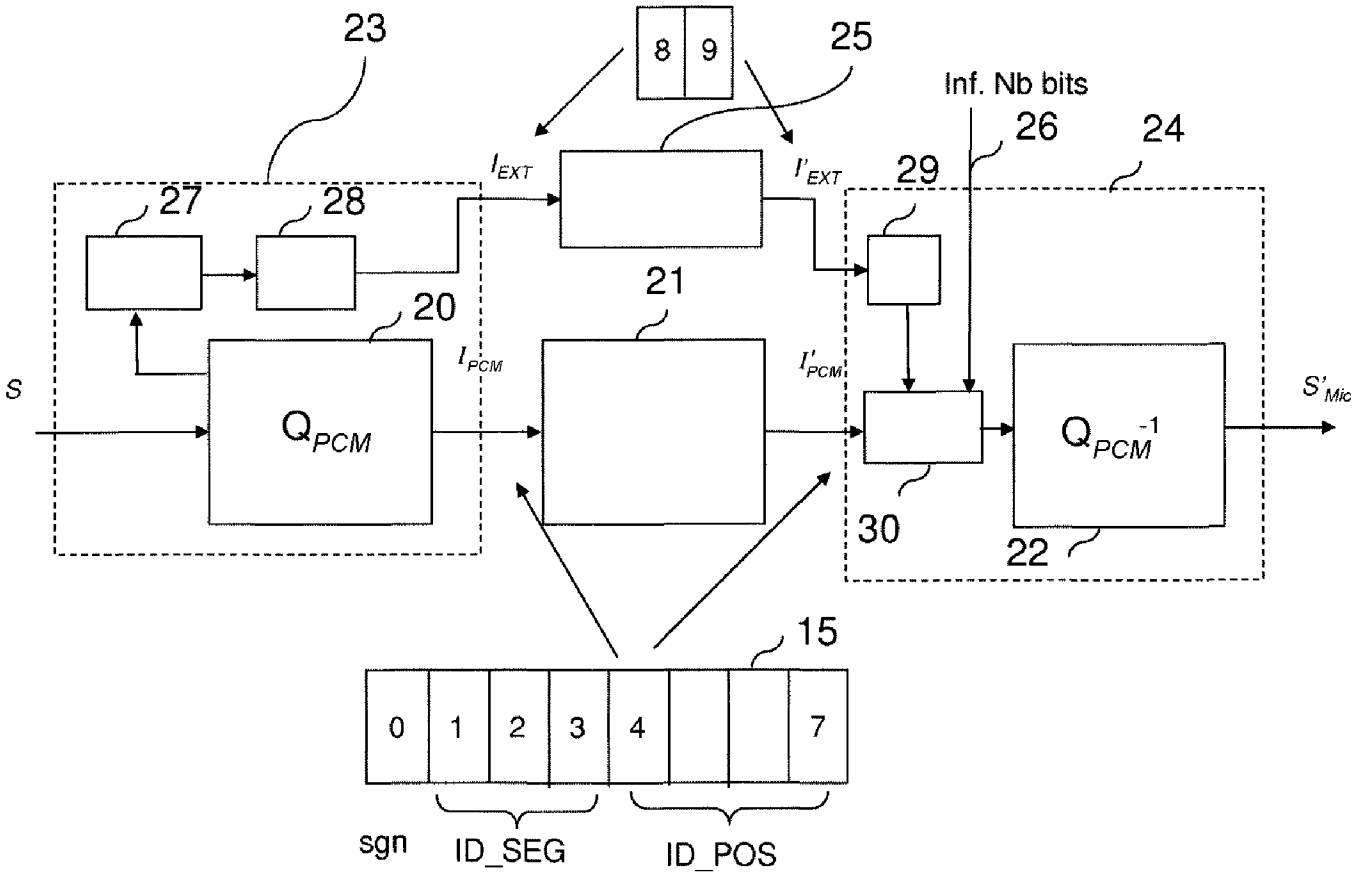
FIG. 2 illustrates a coding/decoding system according to the invention, together with the methods according to the invention, implemented by the elements of this system.

FIG. 2 illustrates a coding/decoding system according to the invention.

A coder 23 comprises a quantifier $Q_{PCM}$ 20 capable of quantizing the input signal S in order to obtain a frame of quantization indices $I_{PCM}$ which is transmitted over the transmission channel 21 to a decoder 24.

In one particular embodiment, this coder is of the PCM coder type and implements a coding law of the A or mu type such as is described in the G.711 standard.

The frame of quantization indices obtained is therefore shown in 15 and is in accordance with the frame of the G.711 A or mu law type.

Methods for implementation of the A and mu coding laws are included in the G.711 standard. They consist in determining the final quantization index by simple operations of low complexity which avoid storing large tables of values.

Thus, the pseudo-code shown in Appendix A-10 gives an example of implementation of the A law such as described in the G.711 standard (with a linear approximation by segments of the amplitude compression law). One concrete implementation of this pseudo-code is also given by way of example in Appendix A-10. This implementation is in accordance with the recommendation ITU-T G.191 Software Tool Library (STL-2005), Chapter 13 "ITU-T Basic Operators". This recommendation is accessible on the ITU Internet website:

http://www.itu.int/rec/T-REC-G.191-200508-I/en

It can be seen in this pseudo-code that the quantization index over 8 bits comprises the sign bit (sign), the index of the segment (exp) and the position on the segment (mant).

Figure 1:
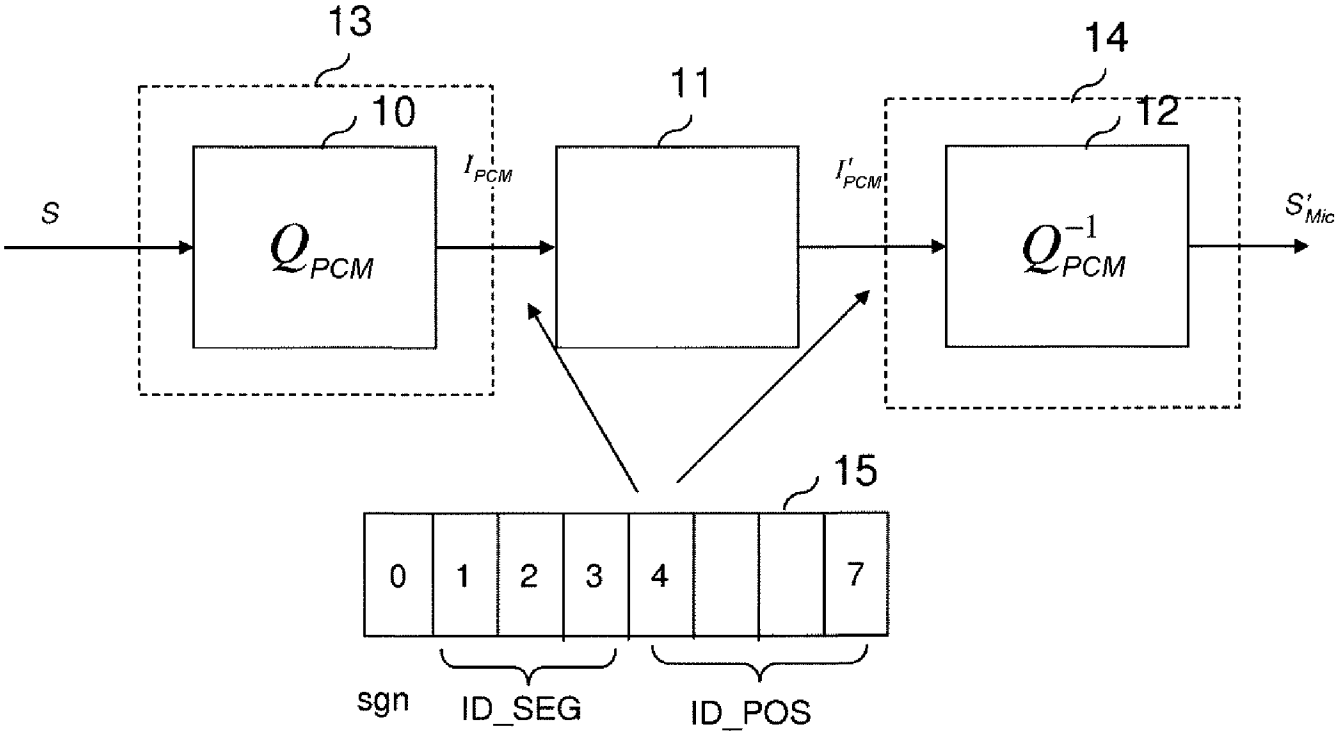
Fig.1 (Prior art)
FIG. 1 illustrates a conventional G.711 PCM coding/decoding system from the prior art.

In a first part of this coding, the sign bit that goes at the position 0, as indicated in 15 in FIG. 1, is determined. Then, the position of the most significant bit "pos" is sought and the segment number is calculated and coded over 3 bits that are placed at the positions 1, 2 and 3 as shown in 15 in FIG. 1.

The 4 bits forming the position on the segment are placed at the positions 4, 5, 6 and 7 as shown in 15.

There is always a shift of bits to the right of at least 4 bits (x=shift_right (x, pos−4)) and hence 4 bits lost; Therefore, only the most significant bits (MSB) are used in order to form the frame of quantization indices. The minimum value of the variable "pos" for the coding according to the A law is 8. For all the segments, there are therefore at least 4 of the least significant bits that are lost. The compression for the process of amplitude compression is thus achieved.

For an input signal with a 16 bit resolution per sample (in "linear PCM" format), the smallest quantization step is 16, the 4 least significant bits being lost. Table 2 hereinafter gives the thresholds and quantization step for each segment for the G.711A law.

TABLE 2

Quantization steps for G.711 A law

| Segment | Lower threshold | Upper threshold | Quantization step |
|---|---|---|---|
| 0 | 0 | 255 | 16 |
| 1 | 256 | 511 | 16 |
| 2 | 512 | 1023 | 32 |
| 3 | 1024 | 2047 | 64 |
| 4 | 2048 | 4095 | 128 |
| 5 | 4096 | 8191 | 256 |
| 6 | 8192 | 16383 | 512 |
| 7 | 16384 | 32767 | 1024 |

In the same way, the decoding can be implemented by simple operations as the pseudo-code and the ITU-T STL-2005 implementation shown in Appendix A-11 illustrate.

It can be seen in this pseudo-code that the sign (sign), the segment (exp) and the value in the segment (val) are recovered from the 8-bit index (index). A rounding value equal to 8 and corresponding to half the quantization step used for a segment is applied in order to obtain the value of the middle of the quantization interval. Thus, the inversion of the amplitude compression process is achieved. The least significant bits that were rejected in the coding are recovered here after approximation.

The mu law version of G.711 is similar to the A law. The main difference is that 128 is added to the values in order to ensure that, in the first segment, bit 7 is always equal to 1, which makes the transmission of this bit redundant and hence increases the precision of the first segment (quantization step 8 in the first segment compared to 16 in the A law). This also enables identical processing of all the segments. In addition, 4 is added (hence 128+4=132 in total) for the rounding so as to have the level 0 amongst the quantized values (the A law has no level 0, the smallest values being 8 or −8). The price of this better resolution in the first segment is the shifting of all the segments by 132. Table 3 hereinafter gives the thresholds and the quantization step for each segment for the G.711 mu law.

TABLE 3

| Quantization steps for G.711 mu law | | | |
|---|---|---|---|
| Segment | Lower threshold | Upper threshold | Quantization step |
| 0 | 0 | 123 | 8 |
| 1 | 124 | 379 | 16 |
| 2 | 380 | 891 | 32 |
| 3 | 892 | 1915 | 64 |
| 4 | 1916 | 3963 | 128 |
| 5 | 3964 | 8059 | 256 |
| 6 | 8060 | 16251 | 512 |
| 7 | 16252 | 32635 | 1024 |

Figure 3A:
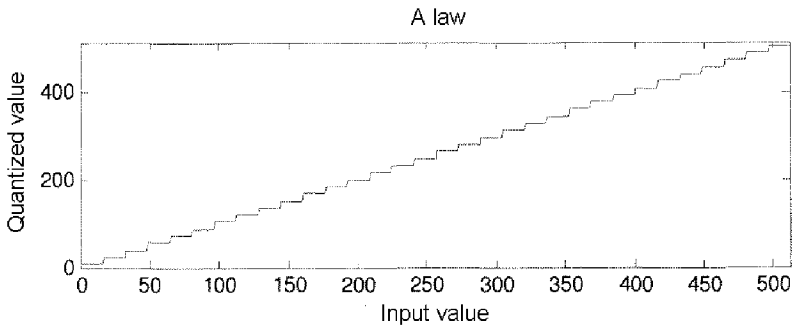
FIGS. 3*a* and 3*b* show the quantized values relative to the input values following application of the A and mu coding laws, respectively, according to the G.711 standard.
Figure 3B:
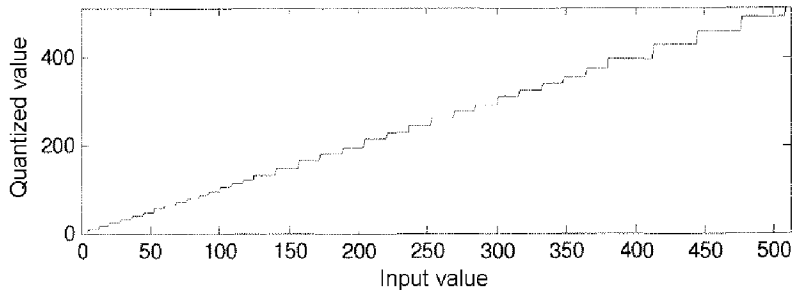

FIGS. 3*a* and 3*b* allow the resolution of these two laws to be compared for the first 512 values.

In the same way as for the A law, a method for implementation without storing tables of values is given by an example of encoding pseudo-code according to the G.711 mu law standard shown in Appendix A-12.

In the same way as for the A law, it can be seen in this pseudo-code that there is always a shift of bits to the right of at least 3 bits (x=shift_right (x, pos−4)), the minimum value of "pos" being 7 for the mu law.

Therefore, only the most significant bits (MSB) are used to form the frame of quantization indices and thus to carry out the amplitude compression step.

The minimum value of the variable "pos" for the coding according to the mu law is 7 since, as previously mentioned, in the case of the mu law the first segment is handled in the same way as the other segments. Hence, for all the segments, there are at least 3 least significant bits that are lost.

As for the A law, the decoding can simply be carried out by a simple algorithm, an example of which is given in Appendix A-13.

The coder 23 according to the invention takes advantage of the method of coding according to A or mu laws by storing in a memory space, shown as reference 27, a part of the least significant bits which have not been taken into account for the coding of the binary frame of quantization indices $I_{PCM}$.

Thus, as previously mentioned for the logarithmic coding according to the A or mu laws, at least 3 bits for all the segments can be stored.

The number of bits lost by the coding methods according to the A or mu law increases with the number of the segment, up to 10 bits for the last segment.

The method according to the invention allows at least the most significant bits among these lost bits to be recovered.

In order to determine an enhancement bit stream with a bit rate of 16 kbit/s, hence with 2 bits per sample, the method according to the invention will store in memory 27 the two most significant bits of the bits that are not taken into account in the compression operation in order to determine the frame of quantization indices.

These bits are recovered for determining, in 28 by determination means from the extension bit stream, the enhancement bit stream $I_{EXT}$. This enhancement bit stream is then transmitted via another transmission channel 25 to a decoder 24.

Thus, the decoder 24 comprising an inverse quantifier, here an inverse PCM quantifier $Q^{-1}{}_{PCM}$ 22, receives in parallel the basic bit stream $I'_{PCM}$ and the enhancement bit stream $I'_{EXT}$.

These streams $I'_{PCM}$ and $I'_{EXT}$ are versions that could be affected by binary errors of $I_{PCM}$ and of $I_{EXT}$, respectively.

In the case where this enhancement bit stream is received by the reception means 29 of the decoder 24, the decoder will then have a greater precision on the location of the decoded sample in the segment. For this purpose, it concatenates the extension bits to the bits received in the basic stream $I'_{PCM}$ by bit concatenation means 30, and then carries out an inverse quantization in 22.

Indeed, the addition of another bit allows the number of segment levels to be multiplied by two. Doubling the number of levels also increases the signal-to-noise ratio by 6 dB. Thus, for each bit added in the enhancement bit stream and received at the decoder, the signal-to-noise ratio will be increased by 6 dB, which in turn enhances the quality of the decoded signal without however significantly increasing the complexity at the coder.

In the example illustrated in FIG. 2, the enhancement bit stream $I_{EXT}$ is composed of two extension bits per sample, i.e. a bit rate of 16 kbit/s. These extension bits can be obtained by applying a bit shift in two operations as is shown by the pseudo-code in Appendix A-14.

It can be seen that, instead of shifting the bits all at once by "pos−4" positions to only keep the 5 most significant bits, as is the case in the coding according to the A law, as a first step a shift of 2 positions less (hence "pos−6" positions) is applied, to keep the 7 most significant bits, and the last two bits are stored in 27. Then, in a second step, a shift of two more bits is made so as to obtain 5 most significant bits of which the first bit, always at 1, is not transmitted. The 4 others are used for the basic bit stream.

The two stored bits are sent in the extension bit stream.

As shown in FIG. 2, these two extension bits may be considered the $8^{th}$ and the $9^{th}$ bit of the compressed signal.

The pseudo-code enabling all of these operations to be performed at the coder for the A law is given in Appendix A-15.

It can be seen that the differences with respect to the conventional G.711 coding (sections underlined and in bold in the appendix) are the steps for shifting in two operations as previously explained and the use of these two stored bits for determining the enhancement bit stream "ext" and transmitting it.

Similarly, for the implementation of the mu law, the corresponding pseudo-code for the coding is shown in Appendix A-16.

The same differences with the conventional coding as for the coding according to the A law are noted.

Figure 4:
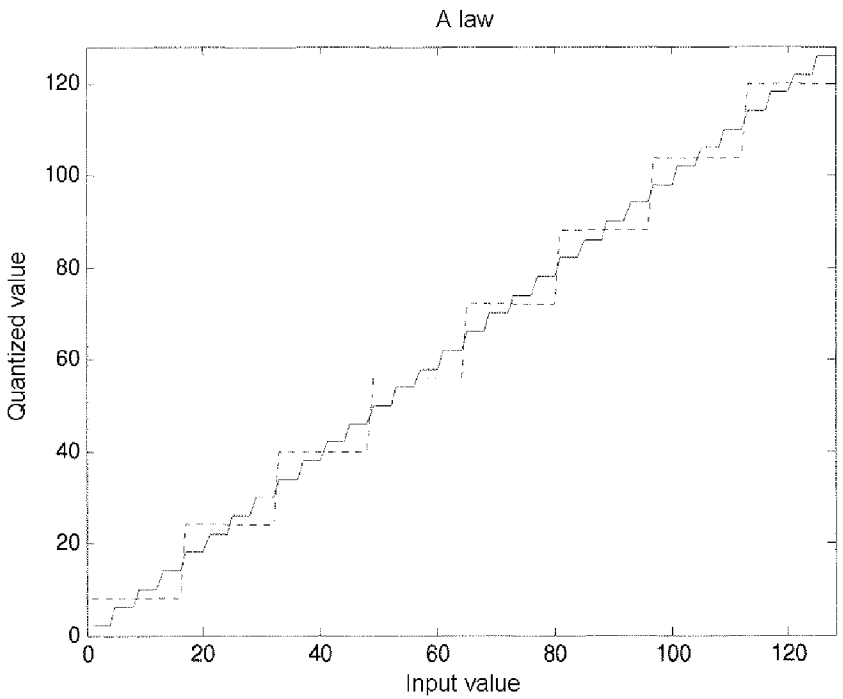
FIGS. 4 and 5 show a comparison with and without implementation of the invention of the quantized values relative to the input values following application of the A and mu coding laws, respectively.

FIG. 4 shows a comparison of the quantized values with respect to the input values between the conventional A law (dashed curve) and the A law with extension of two bits per sample (solid curve), for the first 128 values.

Figure 5:
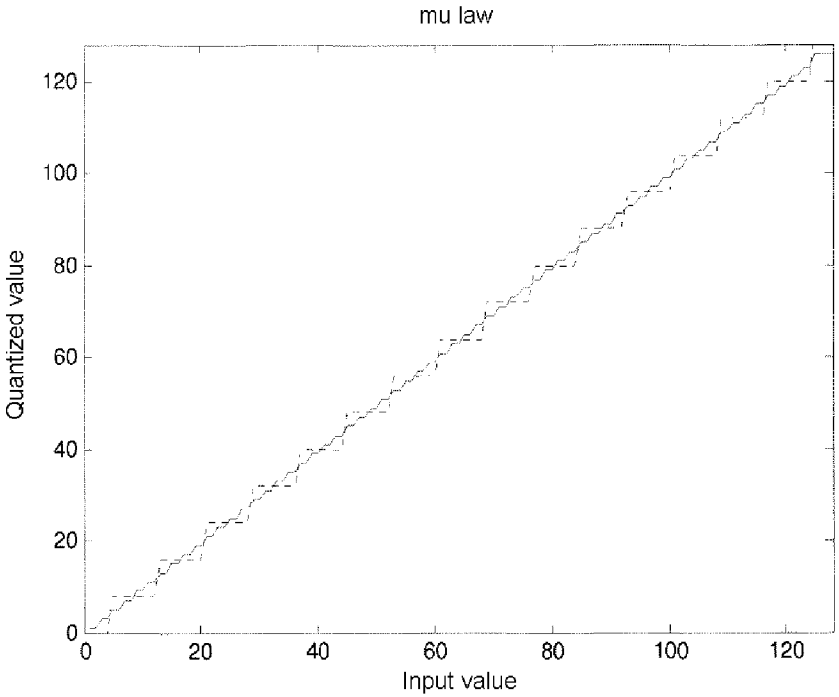

Similarly, FIG. 5 shows a comparison of the quantized values with respect to the input values between the conventional mu law (dashed curve) and the mu law with extension of two bits per sample (solid curve), for the first 128 values.

Upon reception of the enhancement bit stream $I_{EXT}$, the decoder concatenates in 30 the extension bits thus received behind position bits of the basic stream $I'_{PCM}$ in order to carry out the amplitude decompression—or expansion—which is the inverse operation of the amplitude compression process.

Using these additional bits thus allows a greater precision in the location of the decoded sample in the segment to be obtained.

Indeed, for one additional bit, the segment is divided into two. The precision on the location in the segment of the decoded value is then more important.

The rounding value "roundval", which enables the value of the middle of the segment to be found, is also adapted according to the number of extension bits received.

The information on the number of extension bits received is for example given by means of an external indicator as represented by the arrow 26 in FIG. 2.

This information could also be deduced directly by analysis of the extension bit stream.

One example of decoding taking into account these extension bits is given in Appendix A-17 by the pseudo-codes for the A law and the mu law, respectively.

The differences between the conventional decoding and that of the invention (sections underlined and in bold in the appendix) represent the bits of the extension bit stream being taken into account and the application of a rounding value "roundval".

The coder, such as that shown in FIG. 2, comprises a processor of the DSP (for Digital Signal Processor) type, not shown here, and a memory space 27 for storing at least the bits that will be used to determine the extension bit stream.

This memory space 27 can form part of a memory block that also comprises a storage memory and/or a working memory.

The storage means can comprise a computer program comprising code instructions for the implementation of the steps of the coding method according to the invention when they are executed by the processor of the coder.

The computer program can also be stored on a storage medium readable by a drive of the coder or downloadable into the memory space of the coder.

This coder thus implements the method according to the invention for scalar quantization-based coding of the samples of a digital audio signal. The samples are codes over a pre-determined number of bits in order to obtain a binary frame of quantization indices and the coding is carried out according to an amplitude compression law. A pre-determined number of least significant bits are not taken into account in the binary frame of quantization indices. The coding is such that it comprises the following steps:

- storage of at least a part of the least significant bits that are not taken into account in the binary frame of quantization indices;
- determination of an enhancement bit stream comprising at least one bit thus stored.

Similarly, the decoder according to the invention comprises a processor of the DSP type not shown here and is capable of implementing the method of decoding of a binary frame of quantization indices comprising a pre-determined number of bits by an inverse quantization step according to an amplitude compression law. This method is such that it comprises the following steps:

- reception of an enhancement bit stream comprising one or more extension bits;
- concatenation of the extension bits behind the bits coming from the binary frame in order to obtain a decoded audio signal.

This decoder also comprises a storage means (not shown), capable of storing a computer program comprising code instructions for the implementation of the steps of the decoding method according to the invention when they are executed by the processor of the decoder.

The computer program can also be stored on a storage medium readable by a drive of the decoder or downloadable into the memory space of the decoder.

The example shown and explained with reference to FIG. 2 is given for an extension layer of 2 bits per sample. This method is very clearly able to be generalized for another number of bits, for example 1, 2, 3 bits or more. The corresponding pseudo-code would then be as shown in Appendix A-18.

The LSBs "ext_bits" of the variable "ext" are sent in the enhancement bit stream.

It should be noted that the term "pos−4-ext" bits can be negative for ext_bits >3 in the first segments and depending on the law used (A or mu). Even under these conditions, the pseudo-code given would work correctly because shift_right (x, −v)=shift_left(x, v). In other words, in the case where the number of least significant bits that are not taken into account in the frame of quantization indices is less than the number of bits in the extension bit stream, in particular in the first segments, the missing bits just need to be completed in the extension bit stream with zeros. Thus, the most significant bits of the extension bit stream will be the bits stored and recovered according to the invention; the least significant bits will be set to 0.

Since the number of bits stored in the following segments increases, it will no longer be necessary to complete them with zeros.

Similarly, the invention is also applicable in the case where during transmission the bit rate must be reduced. In the case where the extension bit stream comprises two bits, the least significant bit of this extension bit stream is then no longer transmitted.

The decoder then only receives one extension bit per sample. The decoder such as it is described in the pseudo-code by way of example will work correctly with this extension layer reduced to one bit per sample as long as the extension bit received is put into the variable "ext" at the position 1, the bit of position 0 of the variable "ext" is then set to 0 and the value of "roundval" is adapted accordingly.

The value of the variable "roundval" such as used in the examples given therefore depends on the number of bits received by the encoder and on the law used (A or mu). Table 4 hereinafter gives the value of the variable "roundval" in the various situations.

TABLE 4

The value of the variable "roundval" in various configurations

| | enhancement bits received by the encoder | | | |
|---|---|---|---|---|
| | 0 | 1 | 2 | 3 |
| A law | 8 | 4 | 2 | 1 |
| mu law | 4 | 2 | 1 | 0 |

This example therefore shows another advantage of the solution presented which is that the binary train of the extension layer is hierarchical. It is therefore possible to decrease its bit rate in the course of the transmission.

Thus, if the two bits are received by the decoder, the increase in the SNR is 12 dB, if one bit is received, the increase in the SNR is 6 dB.

Of course, this example may also be generalized; for example, the encoder can send 4 bits per sample in the extension layer and the decoder can receive 4, 3, 2, 1 or 0 of these bits, and the quality of the decoded signal will be proportional to the number of extension bits received.

It can be observed in the pseudo-codes given that the additional complexity of the decoding of the extension layer is only two operations per sample at the encoder and 4 operations per sample at the decoder, this being ~0.05 weighted million operations per second (WMOPS), which is negligible. This low complexity may be used to advantage in the case of a hierarchical coding extending G.711 while at the same time allowing, for example in audio conference applications, a "conventional" low-complexity mixing of G.711 stream or extended G.711 stream according to the invention, whereas in the article by Hiwasaki a mixing referred to as "partial mixing", implying a degradation in quality with respect to the conventional mixing, is implemented in order to limit the complexity of the mixing with scalable G.711 coding.

In an alternative embodiment, the invention will not be implemented following the algorithms specified previously by pseudo-code, but by pre-calculating and storing in tables at the coder and/or at the decoder the levels allowing the extension bits to be obtained. This solution has however the drawback of requiring greater memory capacity both at the coder and at the decoder for a small gain in complexity.

APPENDICES:

```
A-10:
function lin__to__Alaw(input__16bit)
    x = input__16bit
    sign = 0x80    /*supposing + */
    if x < 0
        x = ~x    /*abs(x) − 1*/
        sign = 0
    end
    if x > 255 /* 1st bit 1 + 4 saved bits */
        pos = search__position__most__significant__bit__1 (x)    /* 14 >=
        pos >= 8 */
        exp = shift__left(pos − 7, 4)
        x = shift__right(x, pos − 4)
        mant = x − 16    /* remove leading 1 */
    else
        exp = 0
        mant = shift__right(x, 4)
    end
    ind__tmp = sign + exp + mant
    index = xor(ind__tmp, 0x0055)    /* toggle odd bits */
return index    /* only 8LSB bits are used */
Version ITU-T STL-2005:
short lin__to__Alaw(short input__16bit) {
    short x, sign, pos, exp, mant, ind__tmp, index;
    x = input__16bit;
    sign = 0x80; /*supposing + */
    IF(x < 0)
    {
        x = s__xor(x, (short)0xFFFF);    /*abs(x) − 1*/
        sign = 0;
    }
    IF (sub(x, 255) > 0) /* 1st bit 1 + 4 saved bits */
    {
        pos = sub(14, norm__s(x));    /* 14 >= pos >= 8 */
        exp = shl(sub(pos, 7), 4);
        x = shr(x, sub(pos, 4));
        mant = sub(x, 16);    /* remove leading 1 */
    }
    ELSE
    {
        exp = 0;
        mant = shr(x, 4);
    }
    ind__tmp = add(sign, add(exp, mant) );
    index = s__xor(ind__tmp, 0x0055);    /* toogle odd bits */
    return(index); /* only 8LSB bits are used */
  }
A-11:
function    Alaw__to__lin(index)
    sign = and(index, 0x80);
    y = and(xor(index, 0x0055), 0x7F)    /* without sign */
    exp = shift__right(y, 4)
    val = shift__left(and(y, 0xF), 4) + 8    /* with rounding */
    if exp > 0
        val = shift__left(val + 256, exp − 1)    /* add leading 1 */
    end
    if sign == 0    /* sign bit ==0 → negative value */
        val = −val
    end
return val
Version ITU-T STL-2005:
short Alaw__to__lin(short index)
{
```

-continued

APPENDICES:

```
    short y, sign, exp, val;
    sign = s__and(index, 0x80);
    y = s__and(s__xor(index, 0x0055), 0x7F);    /* without sign */
    exp = shr(y, 4);
    val = add(shl(s__and(y, 0xF), 4), 8);    /* rounding */
    if(exp > 0)
    {
        val = shl(add(val, 256), sub(exp, 1));    /*add leading 1 */
    }
    if(sign == 0)    /* sign bit ==0 ' negative value */
    {
        val = negate(val);
    }
    return(val);
}
A-12:
function    lin__to__mulaw(input__16bit)
    x = input__16bit
    sign = 0x80    /* supposing + */
    if x > 32635    /* to avoid overflow after adding 132*/
        x = 32635
    end
    if x < −32635
        x = −32635
    end
    if x < 0
        x = ~x    /*abs(x) − 1*/
        sign = 0x00
    end
    x = x + 132
    /* always 1st bit 1 + 4 saved bits */
    pos = search__position__most__significant__bit__1(x)    /* 14 >=
    pos >= 7 */
    exp = shift__left(pos − 7, 4)
    x = shift__right(x, pos − 4)
    mant = x − 16    /* remove leading 1 */
    ind__tmp = sign + exp + mant
    index = xor(ind__tmp, 0x007F)    /* toggle all bits */
return index    /* only 8LSB bits are used */
A-13:
function    mulaw__to__lin(index)
    sign = and(index, 0x80);
    y = and(xor(index, 0x00FF), 0x7F)    /* without sign */
    exp = shift__right(y, 4)
    val = shift__left(and(y, 0xF), 3) + 132    /* leading 1 &
    rounding */
    val = shift__left(val, exp) − 132 /* suppress encoder offset
    */
    if sign == 0            /* sign bit ==0 → negative value */
        val = −val
    end
return val
A-14:
x = shift__right(x, pos − 6) /* first part of shift*/
    ext = and(x, 0x3) /*save last two bits*/
    x = shift__right(x, 2) /* finish shift*/
A-15:
function    lin__to__Alaw__enh(input__16bit)
    x = input__16bit
    sign = 0x80    /*supposing + */
    if x < 0
        x = ~x    /*abs(x) − 1*/
        sign = 0
    end
    if x > 255    /* 1st bit 1 + 4 saved bits */
        pos = search__position__most__significant__bit__1(x)    /* 14 >=
        pos >= 8 */
        exp = shift__left(pos − 7, 4)
        x =shift__right(x,pos−6)/*firstpartofshift*/
        ext =and(x, 0x3)            /* save last to bits */
        x =shift__right(x, 2)       /* finish shift */
        mant = x − 16    /* remove leading 1 */
    else
        exp = 0
        x =shift__right(x, 2)
        ext = and(x, 0x3)           /* save last two bits */
        x =shift__right(x, 2)       /* finish shift */
    end
```

-continued

APPENDICES:

```
    ind_tmp = sign + exp + mant
    index = xor(ind_tmp, 0x0055)   /* toggle odd bits */
return index, ext          /* only 8LSB bits are used in index and
2LSB bits in ext*/
A-16:
function   lin_to_mulaw_enh(input_16bit)
    x = input_16bit
    sign = 0x80   /* supposing + */
    if x > 32635   /* to avoid overflow after adding 132*/
        x = 32635
    end
    if x < −32635
        x = −32635
    end
    if x < 0
        x = ~x   /*abs(x) − 1*/
        sign = 0x00
    end
    x = x + 132
    /* always 1st bit 1 + 4 saved bits */
    pos = search_position_most_significant_bit_1(x)   /* 14 >=
    pos >= 7 */
    exp = shift_left(pos − 7, 4)
    x =shift_right(x, pos − 6) /* first part of shift */
    ext =and(x, 0x3)          /* save last two bits */
    x =shift_right(x,2)       /* finish shift */
    mant = x − 16   /* remove leading 1 */
    ind_tmp = sign + exp + mant
    index = xor(ind_tmp, 0x007F)   /* toggle all bits */
return index, ext   /* only 8LSB bits are used in index and
2LSB bits in ext*/
A-17:
A law:
function Alaw_to_lin_enh(index, ext, roundval)
    sign = and(index, 0x80);
    y = and(xor(index, 0x0055), 0x7F)   /* without sign */
    exp = shift_right(y, 4)
    ext =shift_left(and(ext,0x03),2)/*putextensionbitsin
    position 2 & 3 */
    val = shift_left(and(y, 0xF), 4) +ext +roundval   /* with
    rounding */
    if exp > 0
        val = shift_left(val + 256, exp − 1)   /* adding leading 1
        */
    end
    if sign == 0 /* sign bit ==0 → negative value */
        val = −val
    end
return val
Mu law:
function mulaw_to_lin_enh(index, ext, roundval)
    sign = and(index, 0x80);
    y = and(xor(index, 0x007F), 0x7F)   /* without sign */
    exp = shift_right(y, 4)
    ext =shift_left(and(ext,0x03),1)/*putextensionbitsin
    position 1 & 2 */
    val = shift_left(and(y, 0xF), 3) + 128 +ext +roundval   /*
    leading 1 & rounding */
    val = shift_left(val, exp) − 132 /* suppress encoder offset
    */
    if sign == 0          /* sign bit ==0 → negative value */
        val = −val
    end
return val
A-18:
x = shift_right(x, pos − 4 − ext_bits)   /* first part of
shift*/
    ext = and(x, shift_left(1, ext_bits) −1)   /* last ext_bits
    bits*/
    x = shift_right(x, ext_bits) /* finish shift*/
```

The invention claimed is:

1. A method for scalar quantization-based coding of the samples of a digital audio signal, comprising:

coding the samples over a pre-determined number of bits in order to obtain a binary frame of quantization indices, the coding being carried out according to an amplitude compression law, where a pre-determined number of least significant bits are not taken into account in the compression operation for forming the binary frame of quantization indices;

storing at least a part of the least significant bits that are not taken into account in the compression operation for forming the quantization index binary frame; and determining an enhancement bit stream comprising at least one of the stored bits.

2. The method as claimed in claim 1, wherein the stored bits are the most significant bits amongst the bits that are not taken into account in the compression operation for forming the binary frame of quantization indices.

3. The method as claimed in claim 1, wherein the number of bits taken into account for determining the enhancement bit stream is a function of the bit rate available during a transmission to a decoder.

4. The method as claimed in claim 1, wherein the scalar quantization step is a quantization of the PCM type according to a logarithmic amplitude compression coding law of the A type or of the mu type in accordance with the ITU-T G.711 standard.

5. A method for decoding said method comprising:

decoding a binary frame of quantization indices comprising a pre-determined number of bits by an inverse quantization step and according to an amplitude compression law;

receiving an enhancement bit stream comprising one or more extension bits determined according to the method as claimed in claim 1; and concatenating the extension bits behind the bits coming from the binary frame in order to obtain a decoded audio signal.

6. The decoding method as claimed in claim 5, further comprising a step for adapting a rounding value according to the number of extension bits received in order to obtain the decoded audio signal.

7. An audio coder comprising:

a module for scalar quantization of the samples of a digital audio signal, the samples being coded over a pre-determined number of bits in order to obtain a binary frame of quantization indices, the coding being applied according to an amplitude compression law, a pre-determined number of least significant bits not being taken into account in the compression operation for forming the binary frame of quantization indices;

memory capable of storing at least a part of the least significant bits that are not taken into account in the compression operation for forming the quantization index binary frame; and means for determining an enhancement bit stream comprising at least one bit thus stored.

8. An audio decoder:

said audio decoder being capable of decoding a binary frame of quantization indices comprising a pre-determined number of bits by an inverse quantization module and according to an amplitude compression law; said audio decoder comprising:

means for receiving an enhancement bit stream comprising one or more extension bits determined by a coder as claimed in claim 7; and means for concatenating the extension bits behind the bits coming from the binary frame in order to obtain a decoded audio signal.

9. A non-transitory computer readable storage medium storing a computer program comprising code instructions for the implementation of the steps of the coding method as claimed in claim 1 when it is executed by a processor of a coder.

10. A non-transitory computer readable storage medium storing a computer program comprising code instructions for the implementation of the steps of the coding method as claimed in claim 5 when it is executed by a processor of a decoder.

* * * * *